US011261002B2

(12) United States Patent
Kira et al.

(10) Patent No.: US 11,261,002 B2
(45) Date of Patent: Mar. 1, 2022

(54) RESIN MADE CONTAINER

(71) Applicant: SUNTORY HOLDINGS LIMITED, Osaka (JP)

(72) Inventors: Go Kira, Tokyo (JP); Dai Sawada, Tokyo (JP); Masatoshi Aihara, Tokyo (JP); Shinya Ito, Tokyo (JP); Takashi Akiyama, Tokyo (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 0 days.

(21) Appl. No.: 16/483,162

(22) PCT Filed: Feb. 27, 2018

(86) PCT No.: PCT/JP2018/007325
§ 371 (c)(1),
(2) Date: Aug. 2, 2019

(87) PCT Pub. No.: WO2018/159630
PCT Pub. Date: Sep. 7, 2018

(65) Prior Publication Data

US 2020/0002045 A1 Jan. 2, 2020

(30) Foreign Application Priority Data

Feb. 28, 2017 (JP) ..... JP2017-037055

(51) Int. Cl.
*B65D 90/02* (2019.01)
*B65D 1/02* (2006.01)

(52) U.S. Cl.
CPC ..... *B65D 1/0223* (2013.01)

(58) Field of Classification Search
CPC ..... B65D 1/0223; B65D 1/44; B65D 1/42; B65D 2501/0018; B65D 2501/0027; B65D 2501/0036; B65D 79/008; B65D 79/0084
(Continued)

(56) References Cited

U.S. PATENT DOCUMENTS 6,044,996 A 4/2000 Carew et al.
7,137,520 B1 * 11/2006 Melrose ..... B65D 1/0223 215/381
(Continued)

FOREIGN PATENT DOCUMENTS

EP 2 653 400 10/2013
JP 2002-326618 11/2002
(Continued)

OTHER PUBLICATIONS

Official Communication issued in International Bureau of WIPO Patent Application No. PCT/JP2018/007325, dated Apr. 24, 2018 (with English translation).
(Continued)

*Primary Examiner* — John K Fristoe, Jr.
*Assistant Examiner* — Elizabeth J Volz
(74) *Attorney, Agent, or Firm* — Greenblum & Bernstein, P.L.C.

(57) ABSTRACT

A resin made container includes a spout portion to/from which a cap can be attached/detached, a shoulder portion continuous with the spout portion, a body portion continuous with the shoulder portion and a bottom portion continuous with the body portion and disposed at a lowermost part. A decompression absorption portion provided in form of a recess in the body portion includes a bulging area protruding to the outer side of the container.

7 Claims, 8 Drawing Sheets

(58) Field of Classification Search
USPC ..... 220/669, 675, 720; 215/381, 382, 383, 215/379, 384
See application file for complete search history.

(56) References Cited

U.S. PATENT DOCUMENTS

| | | | | |
|---|---|---|---|---|
| 7,458,478 | B2 * | 12/2008 | Kamineni | B65D 1/0223 215/379 |
| 8,286,814 | B2 * | 10/2012 | Pritchett, Jr. | B65D 79/005 215/381 |
| 9,102,434 | B2 * | 8/2015 | Howell | B65D 79/005 |
| 2001/0030166 | A1 | 10/2001 | Ozawa et al. | |
| 2010/0320218 | A1 * | 12/2010 | Tanaka | B65D 79/005 220/721 |

FOREIGN PATENT DOCUMENTS

| | | | | |
|---|---|---|---|---|
| JP | 2002326618 | * | 11/2002 | B65D 1/02 |
| JP | 2012-126449 | | 7/2012 | |
| JP | 2012-140148 | | 7/2012 | |
| JP | 2012140148 | * | 7/2012 | B65D 1/02 |
| JP | 2013-177155 | | 9/2013 | |
| JP | 2013177155 | * | 9/2013 | B65D 1/02 |
| JP | 2016-132501 A | | 7/2016 | |
| JP | 2017-13845 | | 1/2017 | |
| JP | 2017013845 | * | 1/2017 | B65D 1/02 |
| WO | 97/14617 | | 4/1997 | |
| WO | 2009/096222 | | 8/2009 | |

OTHER PUBLICATIONS

International Preliminary Report on Patentability issued in International Bureau of WIPO Patent Application No. PCT/JP2018/007325, dated Sep. 3, 2019 (with English translation).
Extended European Search Report in EP Application No. 18 76 0683, dated Jan. 14, 2021 (in English).
Chinese Office Action, Chinese Patent Office, Application No. 201880014235.2, dated Apr. 27, 2021, English translation.

* cited by examiner

RESIN MADE CONTAINER

TECHNICAL FIELD

The present invention relates to a resin made container such as a PET bottle.

BACKGROUND ART

In recent years, with increasing awareness of environmental issues, an effort is being made positively for further weight reduction of resin made containers. However, with decrease in the thickness of the container resulting from weight reduction, there arises a problem of difficulty in ensuring buckling resistance for the container.

As a conventional resin made container designed to solve such problem, there is known an arrangement attempting to prevent buckling deformation of the container by providing e.g. a vertically elastically deformable cushion portion at a body portion of the container for absorbing a shock/load applied from the vertical direction (see Patent Document 1).

BACKGROUND ART DOCUMENT

Patent Document

Patent Document 1: Japanese Unexamined Patent Application No. 2012-126449 Publication Document

SUMMARY OF THE INVENTION

Problem to be Solved by Invention

However, with the conventional resin made container described above, sufficient buckling resistance cannot always be obtained when further weight reduction is sought for. Thus, there remains room for improvement. Therefore, the object of the present invention is to realize further weight reduction of a resin made container and ensuring of bucking resistance while maintaining decompression absorption capability.

Solution

According to a characterizing feature of a resin made container relating to the present invention, the resin made container comprises:

a spout (mouth) portion to/from which a cap can be attached/detached;

a shoulder portion continuous with the spout portion;

a body portion continuous with the shoulder portion; and a bottom portion continuous with the body portion and disposed at a lowermost part;

wherein a decompression absorption portion provided in form of a recess in the body portion includes a bulging area protruding to the outer side of the container.

According to a further characterizing feature of the resin made container relating to the present invention, a vertical sectional shape of the bulging area is curved to protrude to the outer side of the container.

According to a still further characterizing feature of the resin made container relating to the present invention, a horizontal sectional shape of the bulging area is curved to protrude to the outer side of the container.

According to a still further characterizing feature of the resin made container relating to the present invention, downwardly of the decompression absorption portion, there is provided a cushion portion that is elastically deformable in the vertical direction.

According to a still further characterizing feature of the resin made container relating to the present invention, the container has a weight/internal capacity of 50 g/L or less.

According to a still further characterizing feature of the resin made container relating to the present invention, the bulging portion has a bulging amount less than 1 mm.

According to a still further characterizing feature of the resin made container relating to the present invention, a horizontal cross sectional shape of the bulging area has a curvature radius less than 80 mm.

Effect of Invention

According to the above-described configuration, a decompression absorption portion provided in form of a recess in the body portion includes a bulging area protruding to the outer side of the container. With this, when a shock/load is applied from the vertical direction of the container, the bulging area of the decompression absorption portion will bulge to the outer side of the container, thereby absorbing this shock/load, so that reduction in the buckling resistance can be further suppressed.

Namely, when the bulging area in the decompression absorption portion of the resin made container is curvedly deformed to be retracted to the inner side due to an internal pressure variation or the like after hot pack (high temperature) filling, if a shock/load is applied to this resin made container from the vertical direction, the bulging portion will try to regain its original shape, thus bulging to the outer side of the container, whereby the shock/load can be absorbed. Therefore, with provision of the bulging area in the decompression absorption portion, the buckling resistance of the resin made container can be enhanced. Further, since the above-described effect of the bulging area becomes more efficient with decreased in the thickness of the container, further weight reduction of the container is made possible. Moreover, in the case of aseptic room temperature filling, an internal pressure variation or the like will not be so large as that occurs in the case of hot pack filling. Yet, with the provision of the bulging area protruding to the outer side of the container, there is secured some room for free movement of the decompression absorption portion due to such internal pressure variation. Thus, in the event of application of a shock/load to this resin made container from the vertical direction, internal pressure reduction can be suppressed by decreasing the bulging to the outer side of the container, so that the buckling resistance of the resin made container can be enhanced.

Moreover, in particular, in the case of a resin made container subjected to the hot pack filling, with provision of a vertically elastically deformable cushion portion downwardly of the decompression absorption portion, when a shock/load is applied to the container from the vertical direction, firstly the bulging area of the decompression absorption portion will bulge to the outer side of the container and then the cushion portion will be elastically deformed. With this action, the shock/load absorption ability of the cushion portion is improved over a case of not providing such decompression absorption portion. Accordingly, there will be provided an even greater shock/load absorption ability than the case of simple added-up combination of the shock/load absorption ability of the decompression absorption portion and the shock/load absorption ability of the cushion portion. As a result, the buckling resistance of the resin made container can be enhanced dramatically. Moreover, in the case of a resin made container subjected to the aseptic room temperature filling, when the vertically elastically deformable cushion portion is provided downwardly of the decompression absorption portion, at the time of application of a shock/load to the container from the vertical direction, the cushion portion will be elastically deformed. With this action, the shock/load absorption ability of the cushion portion can still suppress reduction in the internal pressure in spite of the presence of the decompression absorption portion. Therefore, reduction in the internal pressure can be suppressed in spite of the provisions of the decompression absorption portion and the cushion portion, the buckling resistance of the resin made container can be enhanced dramatically.

MODES OF EMBODYING THE INVENTION

First Embodiment

Figure 1:
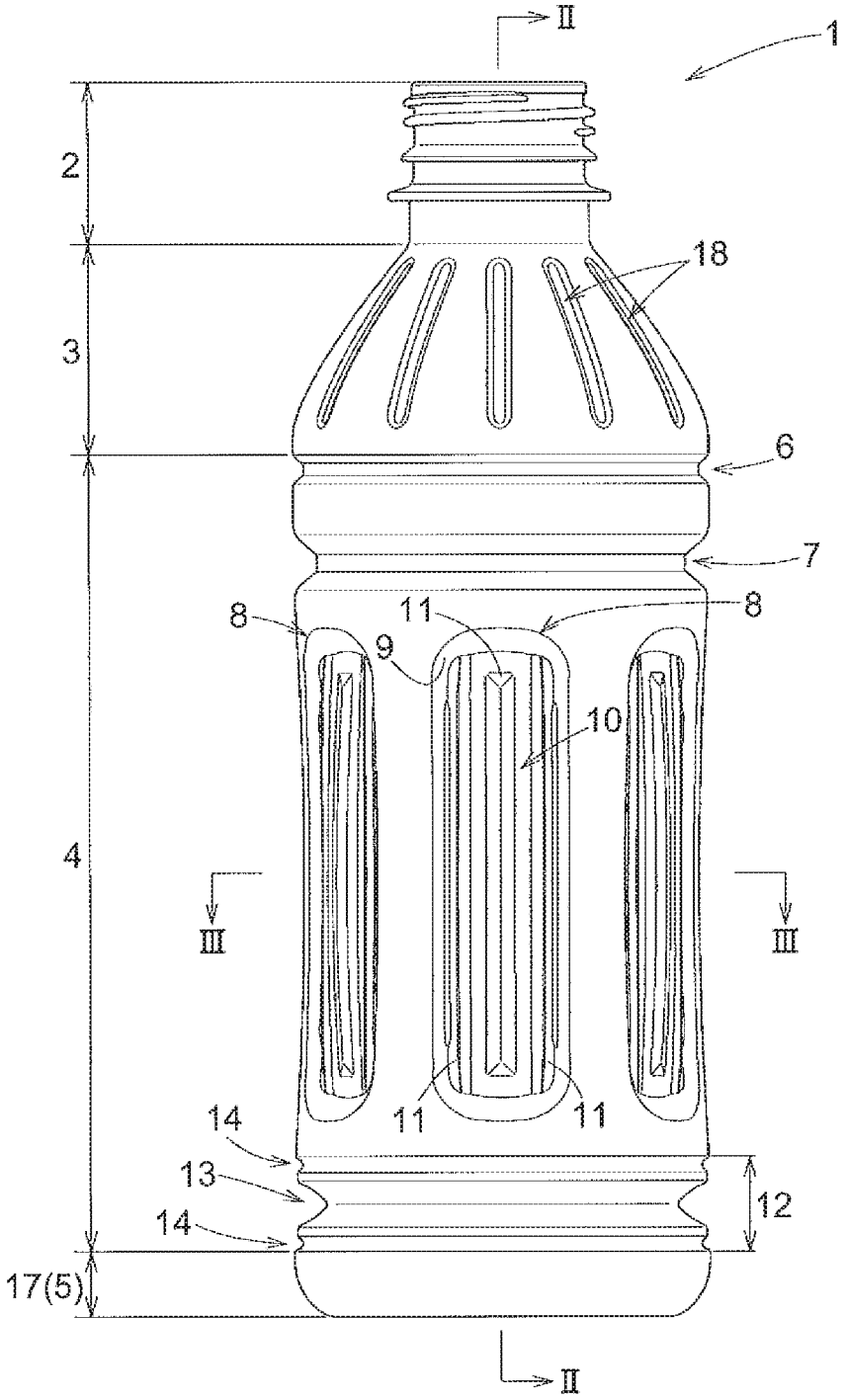
FIG. 1 is a side view showing a resin made container (first embodiment)

Next, as a preferred embodiment of the resin made container relating to the present invention, with reference to the accompanying drawings, there will be explained a plastic bottle 1 in which liquid such as beverage is to be hot-pack filled.

First, various terms to be used in this detailed description will be defined as follows.

In this detailed disclosure, the term "vertical direction" means the direction of center axis X-X of the plastic bottle 1 in FIG. 1 (to be referred to shortly as "bottle 1" hereinafter). In particular, in FIGS. 1-3, the upper side denotes the upper end side in the drawings and the lower side denotes the lower end side in the drawings.

The term "lateral direction" or "horizontal direction" means the direction perpendicular to the center axis X-X.

The term "circumferential direction" means the direction along the contour of the horizontal sectional shape.

The term "radial direction" means the radial direction of a circle having the center axis X-X as its center.

The term "height" means the length along the center axis X-X.

The term "depth" means the length along the radial direction.

The term "horizontal sectional shape" means the sectional shape of the bottle 1 in a plane (horizontal cross sectional plane) perpendicular to the center axis X-X.

The term "vertical sectional shape" means the sectional shape of the bottle 1 in a plane (vertical cross sectional plane) along the center axis X-X.

Figure 2:
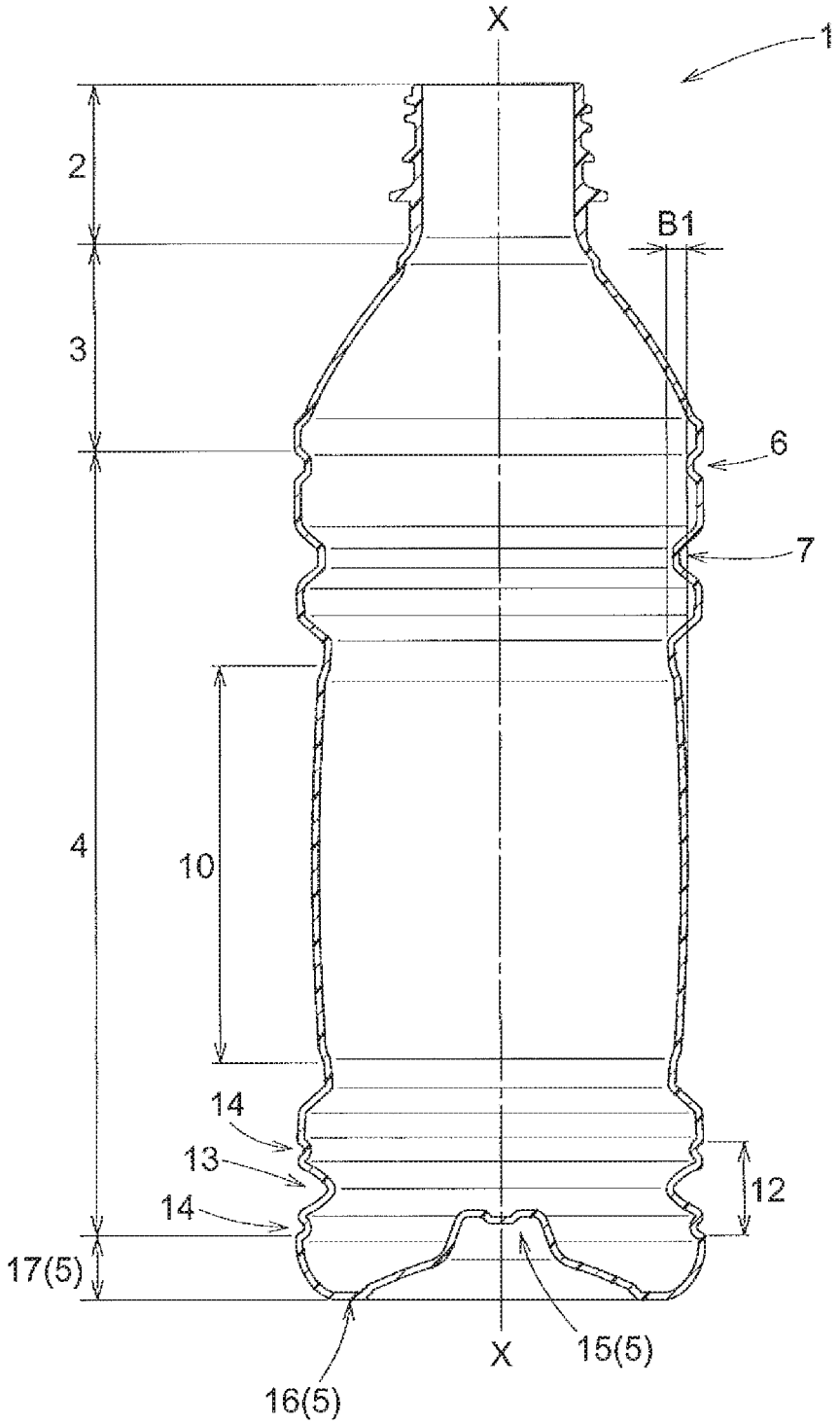
FIG. 2 shows a vertical section of the resin made container along an arrow line of sight II-II in FIG. 1.

As shown in FIG. 1 and FIG. 2, the bottle 1 relating to the instant embodiment includes, in the order from the upper side, a spout (mouth) portion 2 to/from which a cap can be attached/detached, a shoulder portion 3 continuous with the spout portion 2, a body portion 4 continuous with the shoulder portion 3, and a bottom portion 5 continuous with the body portion 4 and disposed at the lowermost part. Further, the bottle 1 relating to the instant embodiment is a cylindrical container having an approximately circular horizontal section.

The bottle 1 can be manufactured e.g. by a known molding method such as the biaxial stretch blow molding method with using a thermoplastic resin such as polyethylene, polypropylene, polyethylene terephthalate, etc. as a principal material.

The liquid to be filled in the bottle 1 is not particularly limited. For instance, drinks such as drinking water, tea, juice, coffee, cocoa, soft beverage, alcohol beverage, milk-based drink, soup, or liquid condiment such as source, soy source, etc. can be cited. Further, the internal capacity of the bottle 1 is not particularly limited, either. In accordance with the type of liquid to be filled therein, it may be of a relatively small internal capacity in the order of a few hundreds of milliliters or of a relative large internal capacity in the order of a few litters, as desired. In case the bottle 1 is used as a beverage bottle, it is preferred that its internal capacity be set from 30 mL to 400 mL. Further, respecting the weight/internal capacity of the bottle 1 according to the instant embodiment, it may be set to 50 g/L or less. In particular, in the case of an internal capacity of 350 mL (=0.35 L), its weight can be set to 15 g or less, also.

(Spout Portion)

The spout portion 2 is a portion constituted of a cylinder having its upper end opened and functions as a "spout" for beverage/drink, etc. In the outer circumferential face of this spout portion 2, male thread is formed, to which an unillustrated cap is fixedly threaded detachably.

(Shoulder Portion)

The shoulder portion 3 is an approximately conical-shaped portion having its diameter progressively and continuously increased from its upper end to the lower side. Incidentally, in the shoulder portion 3 in the instant embodiment, a plurality of vertical grooves 18 are formed in the circumferential direction by predetermined intervals.

(Body Portion)

The body portion 4 is a cylindrical portion having an approximately circular horizontal cross section and has the largest outside diameter in the bottle 1. Further, in the outer circumferential face of this body portion 4, a label that shows e.g. the brand of the drink can be provided. In the body portion 4 of the instant embodiment, a first circumferential groove 6 and a second circumferential groove 7 for reinforcement are provided at upper portions of the body portion 4. Incidentally, the depth of the first circumferential groove 6 is shallower than the depth of the second circumferential groove 7; and also the maximum vertical width of the first circumferential groove 6 is smaller than the maximum vertical width of the second circumferential groove 7.

Vertically elongate decompression absorption portions 8 are provided downwardly of the second circumferential groove 7 in the form of recesses by predetermined intervals in the circumferential direction. Each decompression absorption portion 8 includes, at its portion surrounded by its inner side face 9, a bulging area 10 protruding to the outer side of the container.

Figure 3:
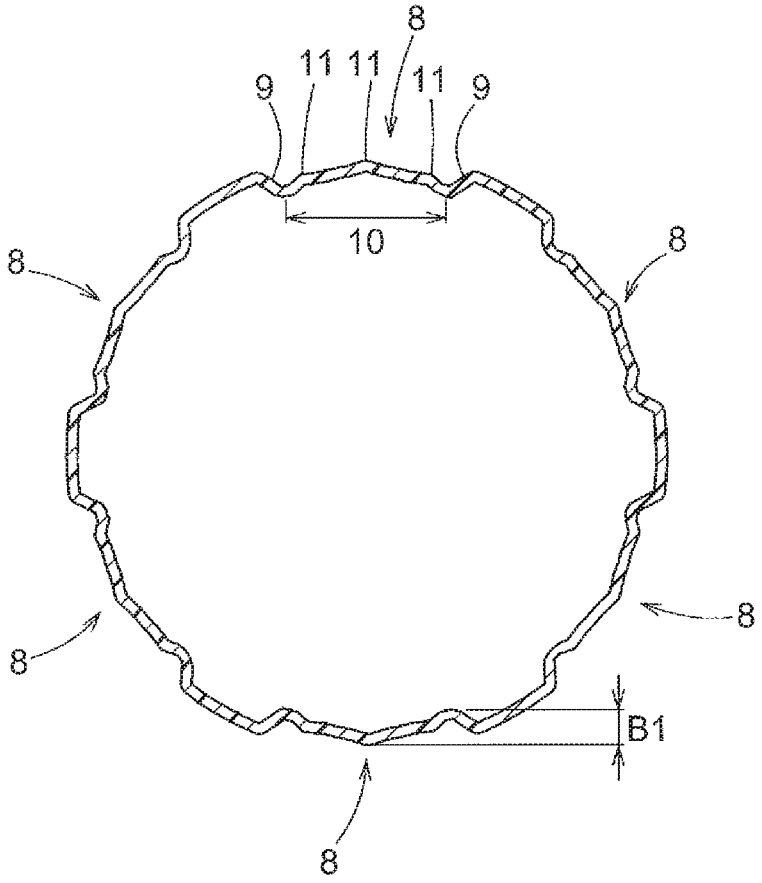
FIG. 3 shows a horizontal section of the resin made container along an arrow line of sight in FIG. 1.

As shown in FIG. 2, the bulging area 10 is curved such that its vertical sectional shape is curved to protrude to the outer side of the container. Further, as shown in FIG. 3, a horizontal sectional shape of the bulging area 10 is curved to protrude to the outer side of the container.

Figure 7:
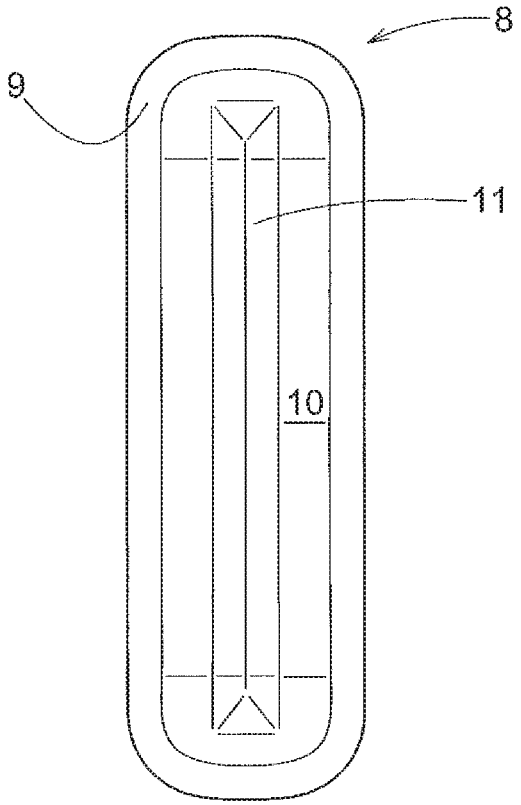
FIG. 7 is a view showing in enlargement a further form of the decompression absorption portion in the resin made container (first embodiment)

At the left and right opposed end portions and the central portion in the horizontal width direction of the bulging area 10, there are respectively provided ridge portions 11 extending in the vertical direction. In the instant embodiment, three such ridge portions 11 are provided in the bulging area 10. However, the invention is not limited thereto. Instead, as shown in FIG. 7 for instance, such ridge portion 11 may be provided only at the central portion in the horizontal width direction of the bulging area 10.

As shown in FIG. 1 and FIG. 2, the bottle 1 includes, at a portion downwardly of the decompression absorption portions 8, a cushion portion 12 which is elastically deformable in the vertical direction. This cushion portion 12 is configured as a bellows-like portion including a V-shaped circumferential groove portion 13 whose width progressively increases toward the radial outer side and having a V-shaped vertical sectional shape and two small circumferential groove portions 14 provided upwardly and downwardly of the V-shaped circumferential groove portion 13 respectively. And, this cushion portion 12 has a line-symmetrical structure having the V-shaped circumferential groove portion 13 as its axis of symmetry, as seen in the vertical cross section. Incidentally, the depth of the V-shaped circumferential groove portion 13 is greater than the depth of the small circumferential groove 14; and the maximum vertical width of the the V-shaped circumferential groove portion 13 is greater than the maximum vertical width of the small circumferential groove portion 14. Thus, the cushion portion 12 is configured as a three-stepped spring structure having three grooves consisting of the V-shaped circumferential groove portion 13 and the two small circumferential groove portions 14. With this, its elastic deformation in the vertical direction is made possible. Incidentally, this cushion portion 12 may be provided only when needed.

(Bottom Portion)

As shown in FIG. 2, in the bottom portion 5, a recess portion 15 which is receded in a chevron-shape protruding to the inner side of the container, a bottom face 16 which comes into contact with an installation face when the bottle 1 is placed erect and a curved portion 17 which is curved toward the outer side from the bottom face 16 to the body portion 4 are provided continuously. The bottom face 16 has an annular shape as seen its plan view and is disposed in the outer circumference of the recess portion 15.

(Behaviors of Decompression Absorption Portion and Cushion Portion in Response to Load Applied from Vertical Direction)

Figure 4:
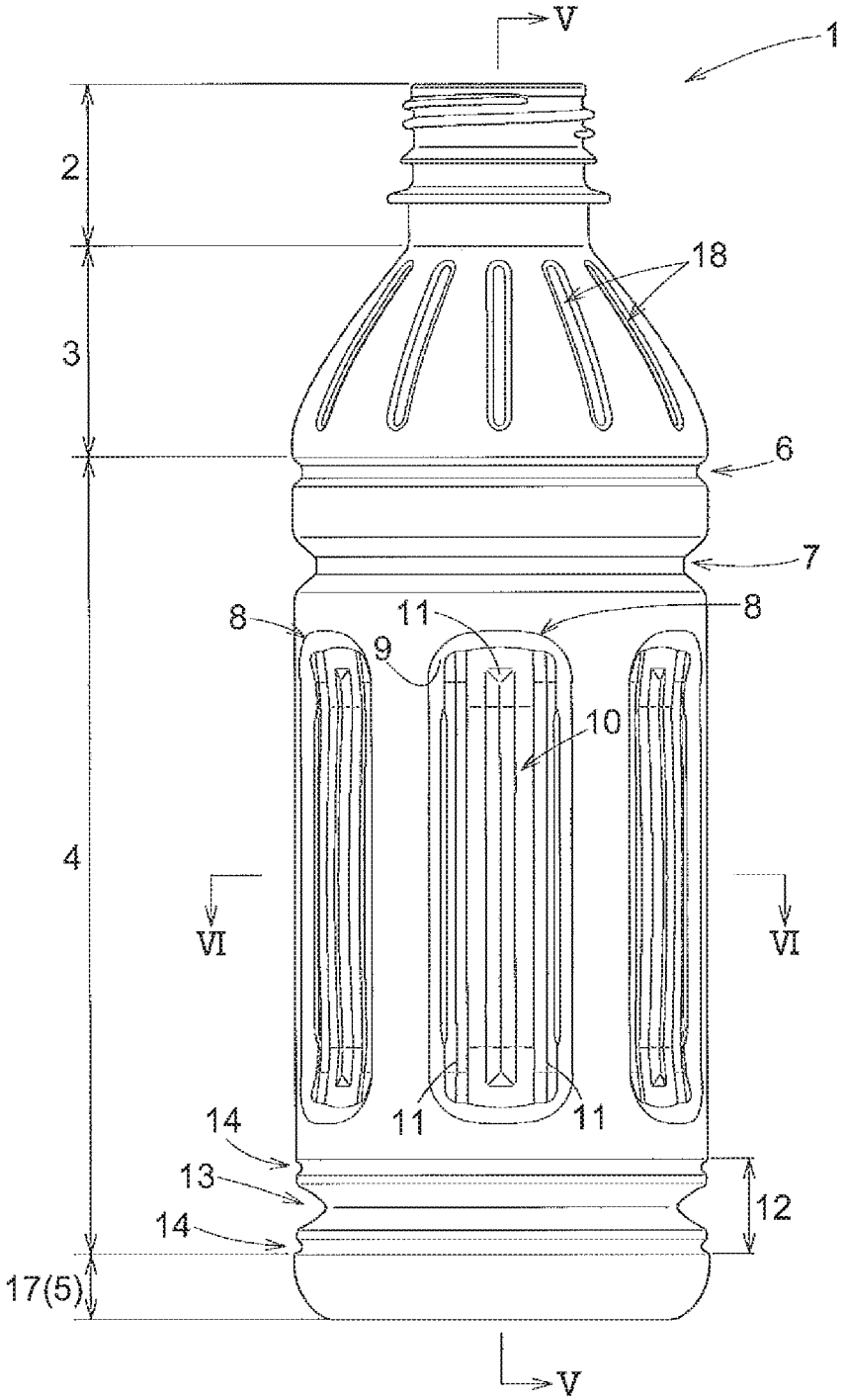
FIG. 4 is a side view of the resin made container (first embodiment) at the time of decompression absorption by a decompression absorption portion.
Figure 5:
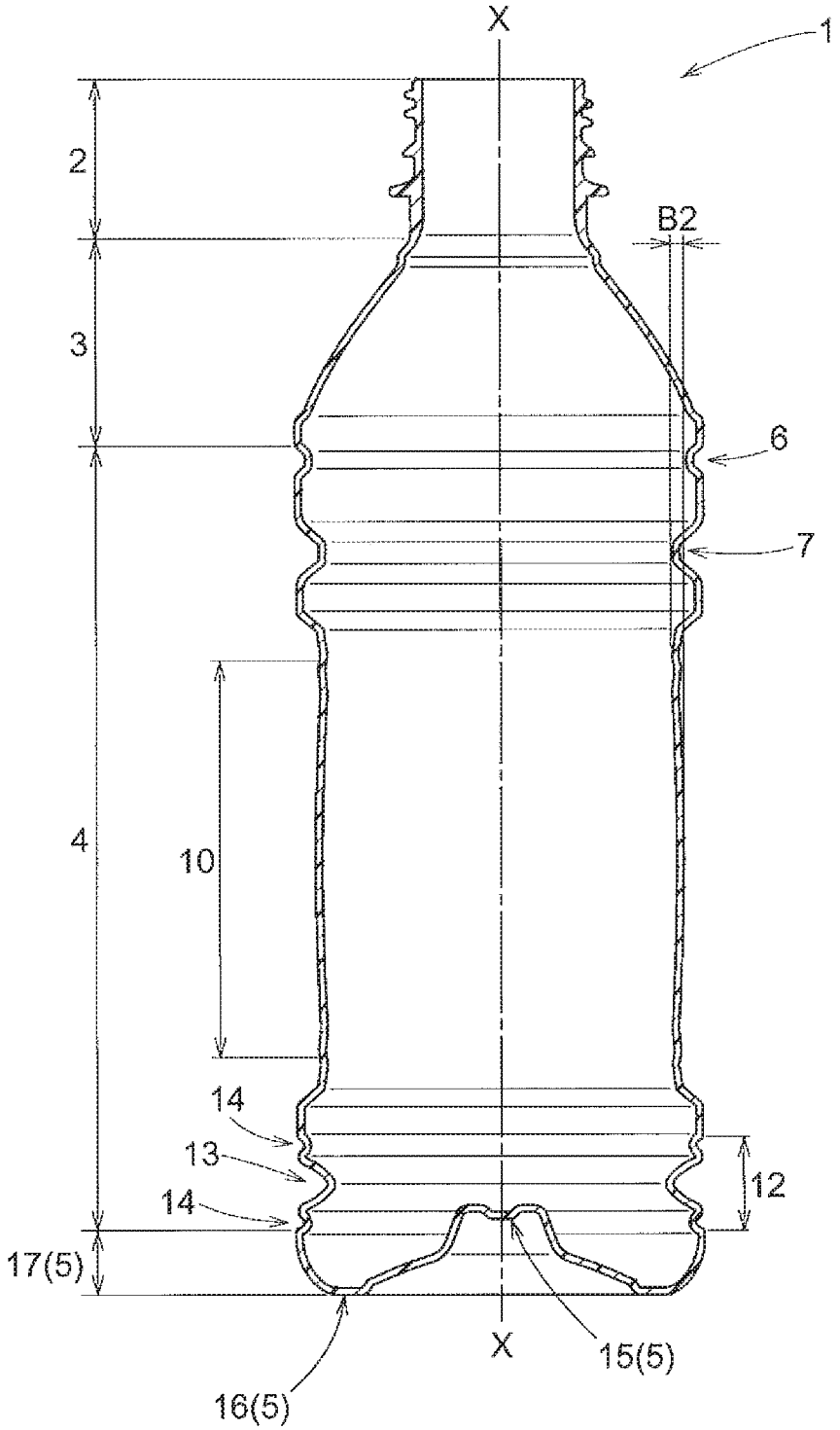
FIG. 5 shows a vertical section of the resin made container along an arrow line of sight V-V in FIG. 4.
Figure 6:
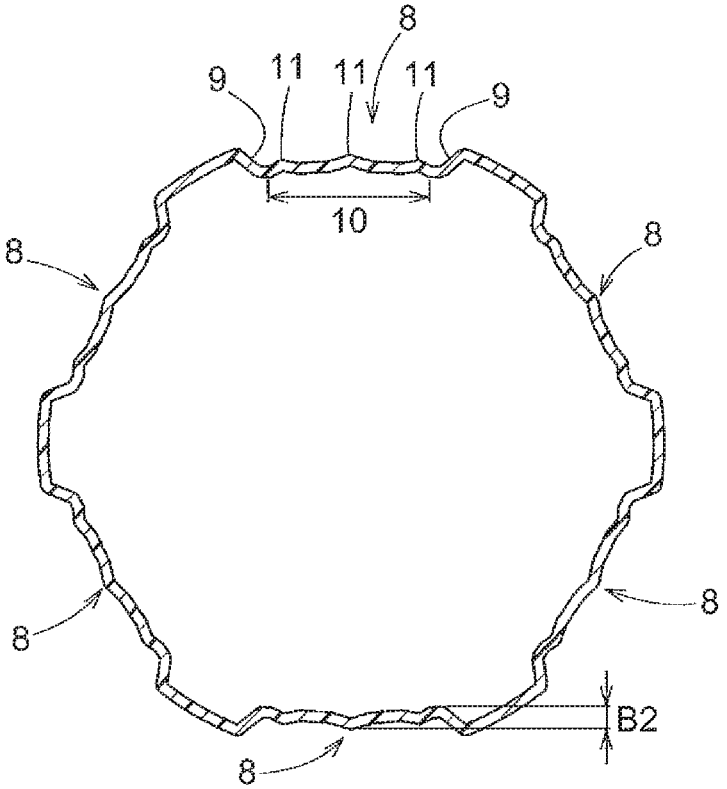
FIG. 6 shows a horizontal section of the resin made container along an arrow line of sight VI-VI in FIG. 4.

FIGS. 1 through 3 show the bottle 1 under a normal condition prior to occurrence of decompression absorption by the decompression absorption portions 8. FIGS. 4 through 6 show the bottle 1 undergoing decompression absorption through curved deformation of the bulging areas 10 of the decompression absorption portions 8 due to e.g. an internal pressure change by hot pack filling or volumetric change in the contents liquid associated with permeation over time of water content thereof, etc., in which the decompression absorption occurs with curved displacement of retraction to the inner side of the bulging areas 10 in the decompression absorption portions 8.

As shown in FIG. 2, FIG. 3, FIG. 5 and FIG. 6, a bulging amount B1 of the bulging area 10 of the bottle 1 under the normal condition is greater than a bulging amount B2 of this bulging area 10 of the bottle 1 at the time of decompression absorption (B1>B2).

In the bottle 1 filled by the hot pack technique with e.g. beverage, decompression absorption occurs. Therefore, normally such bottle 1 will be distributed/sold under the conditions shown in FIGS. 4-6. In this, if a shock or a load is applied to the bottle 1 from the vertical direction, the bulging area 10 of the decompression absorption portion 8 tries to return to its original shape shown in FIGS. 1-3, thus bulging to the outer side of the container, whereby the shock/load can be absorbed. Therefore, by providing the bulging area 10 in the decompression absorption portion 8, the buckling resistance of the bottle 1 can be enhanced. Further, since the above-described action of the bulging area 10 manifests itself the more efficiently, the thinner the bottle 1 becomes. Thus, further weight reduction of the bottle 1 is made possible.

Further, the bottle 1 relating to the instant embodiment is provided, at a position downwardly of the decompression absorption portions 8, with the cushion portion 12 that is elastically deformable in the vertical direction. In this case, at the time of application of a shock/load to the bottle 1 from the vertical direction, after bulging of the bulging area 10 of the decompression absorption portion 8 to the outer side of the container, an action of elastic deformation of the cushion portion 12 occurs. With this action, the shock/load absorbing ability of the cushion portion 12 is improved over the case providing no decompression absorption portions 8. Accordingly, there will be provided an even greater shock/load absorption ability than the case of simple added-up combination of the shock/load absorption ability of the decompression absorption portion 8 and the shock/load absorption ability of the cushion portion 12. As a result, the buckling resistance of the bottle 1 can be enhanced dramatically.

Second Embodiment

Next, respecting a second embodiment of the present invention, with reference to the accompanying drawings, there will be described a plastic bottle 1 having a liquid such as beverage filled thereby by aseptic room temperature filling method. In the following discussion, explanation of the same arrangements as those of the foregoing first embodiment will be omitted and explanation will be made mainly on different arrangements.

Figure 8:
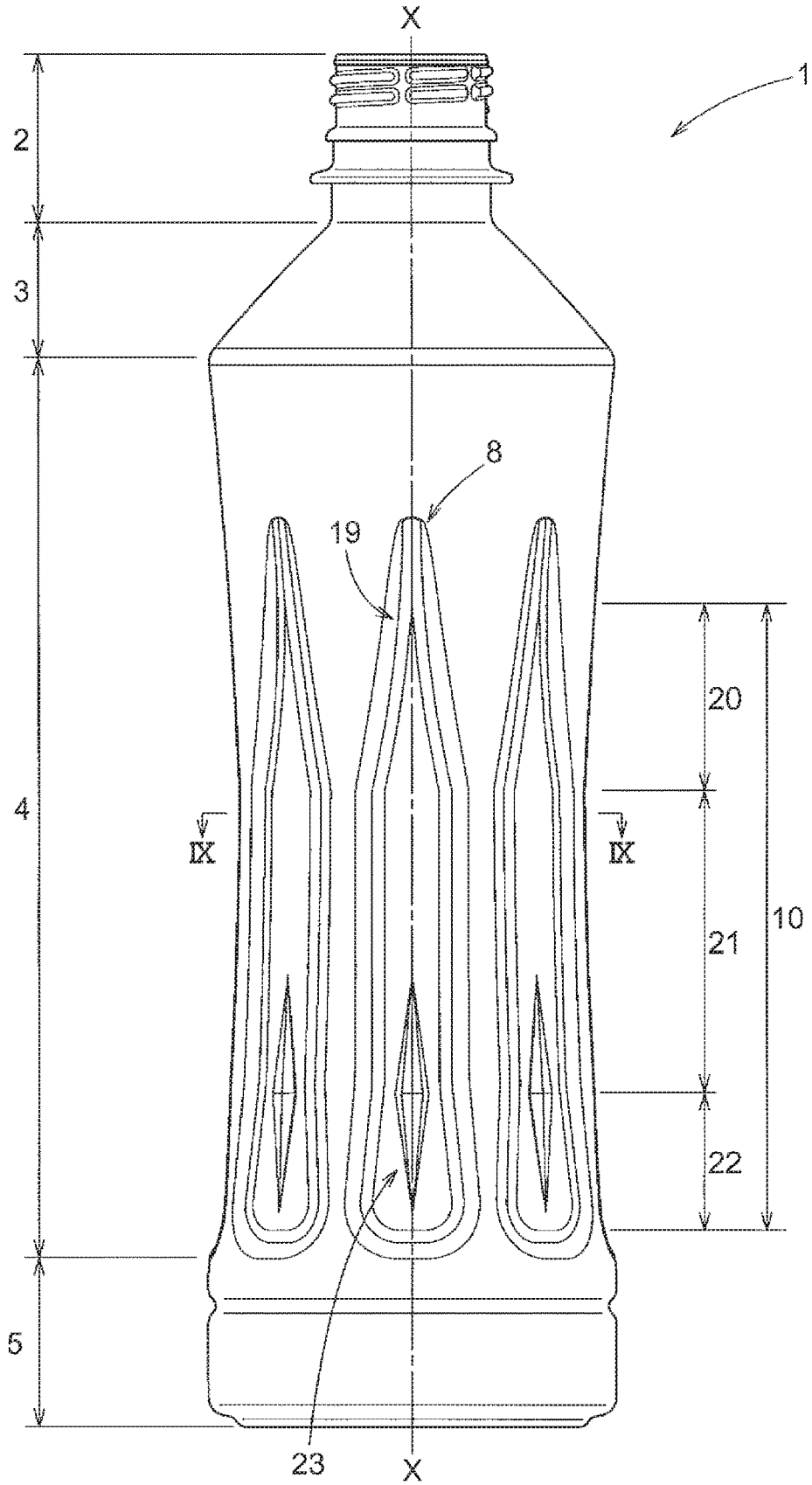
FIG. 8 is a side view showing a resin made container (second embodiment)

As shown in FIG. 8, the bottle 1 relating to the instant embodiment includes, in the order from the upper side, a spout (mouth) portion 2 to/from which a cap can be attached/detached, a shoulder portion 3 continuous with the spout portion 2, a body portion 4 continuous with the shoulder portion 3, and a bottom portion 5 continuous with the body portion 4 and disposed at the lowermost part. Further, the bottle 1 relating to the instant embodiment is a cylindrical container having an approximately circular horizontal section.

The body portion 4 in this embodiment has its diameter progressively reduced from its upper end to the lower side and and then increased continuously from a position at the approximately half of the body 4 in the vertical direction to be eventually formed continuous with the bottom portion 5.

In the body portion 4, a plurality of decompression absorption portions 8 are provided in the form of recesses in the circumferential direction and by predetermined intervals. Incidentally, the decompression absorption portions 8 in the instant embodiment are provided as recesses which extend between and across both the upper half and the lower half of the body portion 4. A groove 19 having a V-shaped cross section is formed along the contour of each decompression absorption portion 8 and this groove 19 at the upper end of the decompression absorption portion 8 is formed continuous with the lateral face of the body portion 4.

The decompression absorption portion 8 includes, at a portion thereof surrounded by the groove 19, a bulging area 10 formed to protrude to the outer side of the container. In the bulging area 10, a tapered area 20 having a horizontal width progressively decreasing toward the upper side and a depth progressively decreasing toward the upper side, a constant area 21 having a constant horizontal width equal to the maximum horizontal width of the tapered area 20, and an enlarged area 22 having a horizontal width progressively increasing from the constant area 21 are formed continuously in this order from the upper side. In the instant embodiment, the tapered area 20 is provided at an upper half of the body portion 4. Incidentally, a ratio of the area of the bulging area 10 relative to the total surface area of the bottle 1 ranges approximately from 30% to 45%, preferably.

Figure 9:
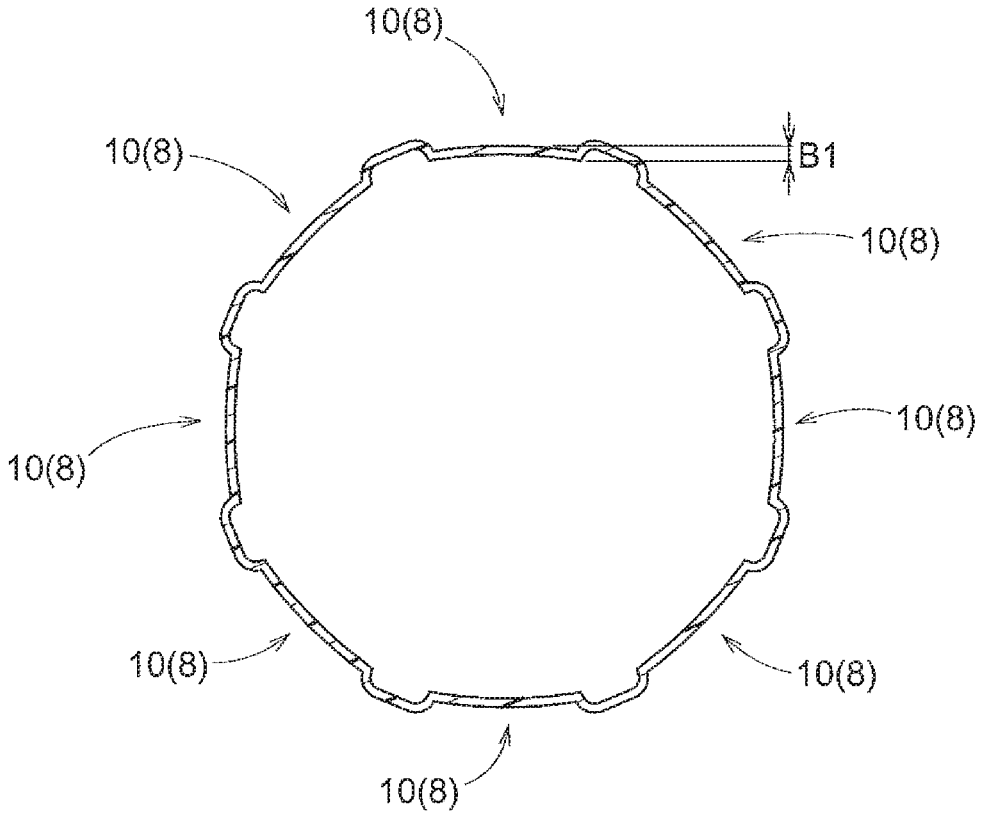
FIG. 9 shows a horizontal section of the resin made container along an arrow line of sight IX-IX in FIG. 8.

As shown in FIG. 9, the horizontal cross sectional shape of the bulging area 10 is curved to protrude to the outer side of the container. Further, though not shown, the vertical cross sectional shape of the bulging area 10 is also curved to protrude to the outer side of the container.

In case the bottle 1 relating to the instant embodiment is used as a beverage bottle, preferably, supposing its capacity ranging from 500 mL to 550 mL, its weight should range from 18 g to 21 g. In this case, preferably, in order to allow for more reliable curved displacement of the bulging area 10 to the inner side of the bottle at the time of decompression absorption, the curvature radius of the horizontal cross sectional shape of the bulging area 10 of this bottle 1 under its normal condition should range greater than 0 mm (0R) and less than 80 mm (80R), more preferably greater than 0 mm (0R) and less than about 50 mm (50R), and most preferably greater than 0 mm (0R) and less than about 27 mm (27R). Also, the curvature radius of the vertical cross sectional shape of the bulging area 10 of the bottle 1 under the normal condition is e.g. about 900 mm (900R).

The bulging amount B1 of the bulging area 10 under the normal condition of the bottle 1 is preferably less than 1 mm, more preferably equal to or less than 0.75 mm, still more preferably equal to or less than about 0.5 mm. The beverage bottle configured as described above has higher buckling resistance and decompression absorption ability even when the thickness of the bottle is decreased.

Incidentally, though not shown, the above-described decompression absorption portion 8 may be vertically inverted. In this case, the tapered area 20, the constant area 21 and the enlarged area 22 will be formed continuous from the lower side in this order, and the groove 19 at the lower end of the decompression absorption portion 8 will be formed continuous with the lateral face of the body portion 4. Also, the tapered area 20 will be provided in the lower half of the body portion 4.

In the decompression absorption portion 8, there is formed a recess portion 23 receded to the inner side of the container. In this embodiment, in particular, a recess 23 having a rhombus square pyramid shape is formed between a part of the constant area 21 and a part of the enlarged area 22. However, the shape and the setting position of the concave portion 23 are not limited to the above. Incidentally, in the decompression absorption portion 8, instead of the recess portion 23, a protrusion portion protruding to the outer side of the container may be formed. In this case too, similarly to the case of the recess portion 23, a protrusion portion having a rhombus square pyramid shape may formed between a part of the constant area 21 and a part of the enlarged area 22. However, the shape and the setting position of the protrusion portion are not limited to the above.

EXAMPLES

In connection with the bottle 1 relating to the second embodiment described above, three kinds of PET bottles shown in Table 1 below were made and bucking resistances thereof were checked. Meanwhile, all of these bottles had a weight of 18.3 g. Further, the bulging amounts B1 of the bulging areas 10 and the curvature radii of the horizontal cross sectional shapes of the bulging areas 10 of all of these bottles were values measured at the vertically approximately middle positions of the bulging portions 10 and the curvature radii of the vertical cross sectional shapes of the bulging areas 10 were values measured at the center portions dividing the bulging areas 10 into the left sides and the right sides equally.

TABLE 1

| | Comparison Example | Example 1 | Example 2 |
|---|---|---|---|
| bulging amount B1 (mm) of bulging area 10 | 0.0 (flat face shape) | 0.5 | 1.0 |
| curvature radius (mm) of horizontal cross sectional shape of bulging area 10 | 0.0 | 80.0 | 26.8 |
| curvature radius (mm) of vertical cross sectional shape of bulging area 10 | 900 | 900 | 900 |
| bucking resistance | x | ○ | ○ |

As shown in Table 1, the PET bottles of Example 1 and Example 2 were able to withstand a pressure of 200 N or greater. Whereas, the PET bottle of Comparison Example 1 was unable to withstand the pressure of 200 N or greater and buckled

INDUSTRIAL APPLICABILITY

The resin made container of the present invention can be used suitably as a container to be sealingly filled with a beverage or the like or a condiment or the like.

DESCRIPTION OF SIGNS

1: bottle
2: spout portion
3: shoulder portion
4: body portion
5: bottom portion
6: first circumferential groove
7: second circumferential groove
8: decompression absorption portion
9: inner side face

10: bulging area
11: ridge portion
12: cushion portion
13: V-shaped circumferential groove portion
14: small circumferential groove portion
15: recess portion
16: bottom face
17: curved portion
18: vertical groove
19: groove
20: tapered area
21: constant area
22: enlarged area
23: recess portion
B1: bulging amount at normal time
B2: bulging amount at time of decompression absorption

The invention claimed is:

1. A resin made container comprising:

a spout portion to/from which a cap can be attached/detached;

a shoulder portion continuous with the spout portion;

a body portion continuous with the shoulder portion; and a bottom portion continuous with the body portion and disposed at a lowermost part;

wherein a decompression absorption portion provided in form of a recess in the body portion includes a bulging area protruding to the outer side of the container, when the resin made container undergoes decompression absorption, at least one portion of the bulging area is deformed to retract inwardly so as to have an inward concave curvature on an exterior face of the bulging area in a horizontal cross-section of the bulging area, when the resin made container is not under the decompression absorption, the bulging area is disposed without including any inward concave curvature on the exterior face of the bulging area in the horizontal cross-section of the bulging area, wherein the bulging area includes three ridges extending in a vertical direction, and the at least one portion of the bulging area is disposed between two of the three ridges.

2. The resin made container of claim 1, wherein a vertical sectional shape of the bulging area is curved to protrude to the outer side of the container.

3. The resin made container of claim 1, wherein a horizontal sectional shape of the bulging area is curved to protrude to the outer side of the container.

4. The resin made container of claim 1, wherein downwardly from the decompression absorption portion, there is provided a cushion portion that is elastically deformable in the vertical direction.

5. The resin made container of claim 1, wherein the container has a weight/internal capacity of 50 g/L or less.

6. The resin made container of claim 1, wherein the bulging portion has a bulging amount less than 1 mm.

7. The resin made container of claim 1, wherein a horizontal cross-sectional shape of the bulging area has a curvature radius less than 80 mm.

* * * * *